US006693628B1

(12) United States Patent
Hase et al.

(10) Patent No.: US 6,693,628 B1
(45) Date of Patent: Feb. 17, 2004

(54) METHOD AND DEVICE FOR MONITORING A SETTING OF A PHASE IN FLAT SCREENS

(75) Inventors: Paul Von Hase, Augsburg (DE); Albertus Soemantri, Friedberg (DE)

(73) Assignee: Fujitsu Siemens Computers GmbH, Munich (DE)

( * ) Notice: Subject to any disclaimer, the term of this patent is extended or adjusted under 35 U.S.C. 154(b) by 259 days.

(21) Appl. No.: 09/722,119

(22) Filed: Nov. 27, 2000

Related U.S. Application Data

(63) Continuation of application No. PCT/DE00/00836, filed on Mar. 17, 2000.

(51) Int. Cl.[7] ..... G06G 5/00
(52) U.S. Cl. ..... 345/213; 348/536
(58) Field of Search ..... 345/204, 213, 345/211, 215; 348/536, 537, 539, 540, 542, 653, 654, 497, 516

(56) References Cited

U.S. PATENT DOCUMENTS 5,767,916 A * 6/1998 West ..... 348/537
5,926,174 A 7/1999 Shibamiya et al.
6,005,557 A * 12/1999 Wong ..... 345/204
6,097,444 A * 8/2000 Nakano ..... 348/607
6,195,086 B1 * 2/2001 Perlman et al. ..... 345/213
6,310,618 B1 * 10/2001 Zhang et al. ..... 345/213
6,313,881 B1 * 11/2001 Reinhart et al. ..... 348/572

FOREIGN PATENT DOCUMENTS

DE 39 14 249 A1 12/1990
DE 39 40 796 A1 6/1991
DE 197 51 719 A1 5/1999
WO WO 98/25401 6/1998

* cited by examiner

*Primary Examiner*—Amr Awad
(74) *Attorney, Agent, or Firm*—Laurence A. Greenberg; Werner H. Stemer; Ralph E. Locher

(57) ABSTRACT

A method for monitoring the setting of the phase between the pixel clock rate of a graphics card and the sampling clock rate of a flat screen having an analog interface includes the steps of setting a flag if the phase of the flat screen has been set by the user. The flag is interrogated upon switching on the flat screen and/or upon a change of the video mode at a computer and/or an exchange of the graphics card and/or upon an exchange of the computer. A display is provided or a setting of the phase is initiated if, during the interrogation, it is ascertained that the flag is not set. A device for monitoring the setting of the phase between the pixel clock rate of the graphics card and the sampling clock rate of the flat screen is also provided.

64 Claims, 2 Drawing Sheets

FAST VIDEO SIGNAL WITH OVERSHOOT

SLOW-RESPONSE VIDEO SIGNAL

IDEAL VIDEO SIGNAL

SAMPLING PULSE WITH JITTER

IDEAL VIDEO SIGNAL

SAMPLING PULSE WITH JITTER

METHOD AND DEVICE FOR MONITORING A SETTING OF A PHASE IN FLAT SCREENS

CROSS REFERENCE TO RELATED APPLICATION

This application is a continuation of International Application No. PCT/DE00/00836, filed Mar. 17, 2000, which designated the United States.

BACKGROUND OF THE INVENTION

Field of the Invention

The invention relates to a method and a device for monitoring the setting of the phase between the pixel clock rate of a graphics card and the sampling clock rate of a flat screen having an analog interface.

Flat screens having an analog interface have to be adapted to the graphics card of the connected computer. If the phase or sampling frequency are set incorrectly, the picture is fuzzy and exhibits interference.

Whereas the values for picture position, that is to say the right-left and top-bottom setting, and the sampling frequency can be defined as preset values for standard modes, this is not possible for the phase since the phase depends on the graphics card used and also on the video line.

A microprocessor is usually provided in flat screens according to the prior art, the microprocessor performing the general control of the flat screen. This microprocessor is configured in such a way that it can also identify the video mode set at the computer. If the mode has already been set at the factory or by the user, the flat screen is operated with the stored settings for picture position, sampling frequency and phase. By contrast, if the mode is one which has not yet been implemented in the microprocessor of the flat screen, then standard values are adopted for picture position, sampling frequency and phase. These standard values are not satisfactory in all cases.

The setting of the sampling clock rate and of the phase has a direct effect on the picture quality. An optimum sampling frequency is given when the sampling of all the pixels of a line, for example, of a video signal ensues in a stable or characteristic region of the pixels, for example in the center of each pixel. The data conversion yields optimum results in that case. The picture shown has no interference and is stable. In other words, the optimum sampling frequency is equal to the pixel frequency. If an incorrect sampling frequency is set, for example if the sampling clock rate is too fast in comparison with the pixel clock rate, the pixels are initially sampled in the permissible region, that is to say in the center between two edges, but the subsequent pixels are sampled more and more in the direction of an edge until even the region between two pixels is sampled, which obviously leads to an unsatisfactory picture quality. Incorrect samples are derived in the region where the pixels are not sampled in an optimum, characteristic region. The picture then exhibits a high degree of vertical interference. The greater the difference in frequency between the sampling clock rate and the pixel clock rate, the more regions with vertical interference are visible on the screen.

However, even in cases in which the sampling clock rate is identical to the pixel clock rate, the picture quality can suffer if the phase is not set correctly. The reason is that the sampling takes place in a pixel region which is not ideally suited to sampling, for example too close to the front or back edge of a pixel. This problem can be solved by the phase, that is to say the sampling instant, overall being shifted until the sampling takes place in a characteristic or permissible region of the pixels. If the phase is not set correctly, the picture quality on the entire screen is impaired by noise signals.

Many users are unaware of the relationship between sampling frequency and phase with respect to the picture quality. If the picture is fuzzy, a defect is assumed and after-sales service is enlisted. This leads to unnecessary costs. Indications in the manual or on the packaging of the screen are overlooked by many users. Moreover, some users do not know that every resolution which is used and is set with respect to a graphics card requires a dedicated adjustment. If the picture quality is unsatisfactory for the reasons mentioned above, then in the most favorable case the after-sales service or the hotline of the manufacturer is contacted, whereupon the user is informed of the adjustment to be made to the phase. In some cases, however, entirely satisfactory monitors are returned under warranty even though only the phase must be set correctly.

Published, Non-Prosecuted German Patent Application No. DE 39 14 249 A1 discloses a method for a clock recovery from an input signal generated with an unknown clock, in which the input signal is digitized with a comparison clock in different phase angles. From the profile of the phase angle (input signal to comparison clock), the difference between the clock frequency of the input signal and that of the comparison clock is determined and the frequency of the comparison clock is corrected accordingly.

Published, Non-Prosecuted German Patent Application No. DE 19 751 719 A1 describes a signal processing method for an analog picture signal. In this case, the analog picture signal originates from a computing unit in which the signal has been generated digitally in accordance with a graphics standard, such as e.g. EGA (enhanced graphics adapter), or VGA (video graphics array), and has subsequently been converted into analog form. The method subjects the analog picture signal to an analog/digital conversion with a first, chosen sampling frequency, after which the sampled picture is then investigated for picture disturbances in order to determine a corrected sampling frequency. Further measures relate to the determination of the optimum sampling phase and the determination of the exact position of the active picture relative to the horizontal and vertical synchronizing pulses.

SUMMARY OF THE INVENTION

It is accordingly an object of the invention to provide a method and a device for monitoring the setting of the phase in flat screens which overcome the above-mentioned disadvantages of the heretofore-known methods and devices of this general type and which ensure that the required setting of the phase is performed whenever such a setting or adjusting is required.

With the foregoing and other objects in view there is provided, a method for monitoring, in a flat screen/graphics card/computer system, a setting of a phase between a pixel clock rate of a graphics card and a sampling clock rate of a flat screen having an analog interface, the method includes the steps of:

- setting a flag if a phase of a flat screen has been set from a user-side;
- interrogating the flag upon switching on the flat screen and/or switching a video mode at a computer and/or exchanging a graphics card and/or exchanging the computer; and
- providing a display indication or initiating a setting of the phase if, during the interrogating step, it is ascertained that the flag is not set.

In other words, the method according to the invention is characterized in that a flag is set if the phase of the flat screen has been set by the user, in that the flag is interrogated upon a switch-on of the flat screen and/or upon a changeover of the video mode at the computer and/or an exchange of the graphics card and/or upon an exchange of the computer, and in that a display is provided or a setting of the phase is initiated if, during the interrogation, it is ascertained that the flag is not set. In other words, in addition to the settings which are already stored for each mode, a flag is also inserted which is set as soon as the phase has been set by the user. As a result, the user is not just informed by manuals and other accompanying material of the necessity of effecting phase setting, rather the user is, as it were, compelled to perform the phase setting whenever this is necessary.

If the flat screen is switched on and/or the video mode of the computer is changed over, the processor situated in the flat screen will interrogate the flag stored with respect to the present mode. If the flag is set, that is to say that the flat screen has already been set to the user's system, further operation of the system would proceed as usual. By contrast, if the flag has not yet been set, the flat screen shows a reaction, and a corresponding display takes place or automatic setting of the phase is initiated.

One advantageous embodiment of the method according to the invention is characterized in that the flag is cleared after a change in the video mode at the computer and/or an exchange of the graphics card and/or an exchange of the computer. In the case of new monitors from the factory, the flags must be cleared for all preset modes, since the phase has not yet been set to the user's system. This advantageous embodiment of the method according to the invention can encompass not just these cases but also any alteration to the system which necessitates a phase adjustment. The same applies, of course, also to modes for which there is as yet no presetting in the flat screen.

A further advantageous embodiment of the method according to the invention is characterized in that the flag is set or cleared in a microprocessor in the flat screen, in which case the display is advantageously output via the OSD (on screen display). As a result, the existing hardware is utilized, and costs are saved.

A further advantageous embodiment of the method according to the invention is characterized in that after the setting of the phase and upon identification of a mode change, a check is made to determine whether a line, but at least the first line, above the picture region and/or below the picture region and/or a column, but at least the first column, of the front porch region and/or of the back porch region is/are "black", and in that the flag is set only when the check yields a positive result. It is thus possible to check the phase setting performed by the user, and the user is informed if the phase setting performed is not optimal.

A further advantageous embodiment of the method according to the invention is characterized in that automatic setting of the phase is initiated. In contrast to manual setting of the phase, automatic phase setting is advantageous for many inexperienced users.

An advantageous embodiment of the method according to the invention is characterized in that the rising edge of a video pulse of a sufficiently bright pixel is determined, in that the falling edge of the video pulse in a sufficiently bright pixel is determined, and in that the phase is set in such a way that the sampling instant is located approximately in the center between the rising and falling edges of a video pulse.

Another advantageous embodiment of the method according to the invention is characterized in that the rising edge of a video pulse of a sufficiently bright pixel is determined, and in that the phase is set in such a way that the sampling instant is shifted approximately by half a pixel width in the direction of the pixel center.

A further advantageous embodiment of the method according to the invention is characterized in that the falling edge of the video pulse in a sufficiently bright pixel is determined, and in that the phase is set in such a way that the sampling instant is shifted approximately by half a pixel width in the direction of the pixel center.

Whereas the picture-position and the sampling frequencies can be determined relatively simply through the use of an algorithm and be set accordingly, the phase angle or phase relationship is more difficult to determine. The three exemplary embodiments of the method according to the invention mentioned last are simple and satisfactory methods for setting the phases.

An advantageous embodiment of the method according to the invention, wherein the picture region with the pixels on the flat screen is provided in lines and columns between a back porch region and a front porch region, is characterized in that a pixel in the first picture column next to the back porch region is selected as the sufficiently bright pixel for the determination of the rising edge and a pixel in the first picture column next to the back porch region is selected as the sufficiently bright pixel for the determination of the falling edge. The method can be embodied particularly well if the most pronounced edges are evaluated or if adjacent regions or dots have a greatly different brightness. Therefore, a dot or point respectively in the first or last picture column is particularly well suited since, in combination with the front or back porch region, respectively, it completely satisfies the required conditions and can be found with relatively little outlay.

In the case of automatic phase angle setting or phase position setting, special test patterns having alternately white and black pixels are usually required in previous flat screens having an analog interface, the test pattern having to be displayed by the graphics card. This has the disadvantage that software has to be installed on the computer and started, and that, moreover, the software has to be available for all customary operating systems. By contrast, the above-described advantageous embodiment of the method according to the invention has the advantage that no such test pattern and no corresponding software are necessary in order to carry out the automatic phase setting.

An advantageous embodiment of the method according to the invention is characterized in that the brightness of a plurality of pixels of the first and of the last picture column, respectively, is measured and the pixels having the greatest brightness in the first and last picture column, respectively, are selected for the determination of the rising and falling edge, respectively, of the video pulse. This ensures that pixels having sufficiently pronounced edges are used for the measurement.

An advantageous embodiment of the method according to the invention is characterized in that firstly the pixels ($n \times k$), where $n=1, 2, \ldots N$ and $k$=constant, for example 10, are measured, and in that, if a sufficiently bright pixel has not been found, the pixels $(n+m) \times k$ where $m=1, 2, \ldots N$, are measured until a sufficiently bright pixel is found. As a result, a search for suitable pixels is carried out efficiently and in a short time.

An advantageous embodiment of the method according to the invention is characterized in that in order to determine the amplitude value of the pixel, the phase is shifted until the measured amplitude values no longer change significantly, and in that the amplitude value then determined is then processed further.

As an alternative, one advantageous embodiment of the method according to the invention is characterized in that the phase used during the determination of the amplitude value is advanced until the measured amplitude values are less than a predetermined limit value, for example less than 50% of the amplitude value, in that the phase is delayed by half a dot width or pixel width, and in that the amplitude value which is then measured is processed further.

The two embodiments of the method according to the invention mentioned last are simple solutions for determining the brightness of the pixel, as a precondition for determining the position of the rising and falling edges of the pixel.

A further advantageous embodiment of the invention is characterized in that, in order to determine the rising edge, the phase is shifted in the direction of the back porch region until the measured amplitude value falls to a predetermined percentage, for example 50%, of the amplitude value determined beforehand, and in that this value of the phase is buffer-stored as the location of the rising edge.

Moreover, another advantageous embodiment of the invention is characterized in that, in order to determine the falling edge, the phase is shifted in the direction of the front porch region until the measured amplitude value falls to a predetermined percentage, for example 506, of the amplitude value determined beforehand, and in that this value of the phase is buffer-stored as the location of the falling edge. In this way, the rising and falling edges of two pixels are determined in a simple manner, and the phase can then be set with a magnitude such that it lies between the rising and falling edges, approximately in the center of a pixel.

According to another mode of the invention, the phase or the sampling instant is delayed relative to the center between the rising and falling edges by a predetermined amount, for example 10% of the pixel width.

With the objects of the invention in view there is also provided, in a system including a computer, a graphics card operating with a pixel clock rate, and a flat screen with an analog interface and operating with a sampling clock rate, a device for monitoring a setting between the pixel clock rate and the sampling clock rate, including:

a microprocessor for setting a flag if a phase of the flat screen has been set from a user-side;

the microprocessor performing an interrogation of the flag upon switching on the flat screen and/or switching a video mode at the computer and/or exchanging the graphics card and/or exchanging the computer; and the microprocessor initiating a display indication and/or a setting of the phase, if the interrogation ascertains that the flag is not set.

In other words, the device for monitoring the setting between the pixel clock rate of a graphics card and the sampling clock rate of a flat screen having an analog interface in a flat screen/graphics card/computer system, is characterized by a microprocessor which is configured in such a way that a flag is set if the phase of the flat screen has been set by the user, in that the flag is interrogated upon a switch-on of the flat screen and/or upon a changeover of the video mode at the computer and/or an exchange of the graphics card and/or upon an exchange of the computer, and in that a display is provided or a setting of the phase is initiated if, during the interrogation, it is ascertained that the flag is not set. The simplicity of the device shows that the invention can be implemented with extremely simple measures and in a highly effective manner.

According to another feature of the invention, a setting device is provided for initiating an automatic setting of the phases.

A further advantageous embodiment of the device according to the invention is characterized by a device which determines the rising edge of a video pulse of a sufficiently bright pixel for example in the first picture column next to the back porch region, a device which determines the falling edge of the video pulse in a sufficiently bright pixel in the last picture column next to the front porch region, and a setting device which sets the phase in such a way that the sampling instant is located approximately in the center between the rising and falling edges of a video pulse.

According to another feature of the invention, there is provided a device which determines the rising edge of a video pulse of a sufficiently bright pixel in the first picture column next to the back porch region, and a setting device which sets the phase in such a way that the sampling instant is shifted approximately by half a pixel width in the direction of the pixel center.

According to yet another feature of the invention, there is provided a device which determines the falling edge of the video pulse in a sufficiently bright pixel in the last picture column next to the front porch region, and a setting device which sets the phase in such a way that the sampling instant is shifted approximately by half a pixel width in the direction of the pixel center.

According to a further feature of the invention, there is provided a device for shifting the phase in order to determine the sample or sampling value of the pixel until the measured amplitude values no longer differ significantly, the sample which is then determined being processed further.

According to another feature of the invention, there is provided a device which advances the phase used during the determination of the sample until the measured amplitude values are less than a predetermined limit value, for example less than 50% of the sample, and by a device which then delays the phase by half a pixel width, the sample which is then measured being processed further.

According to yet another feature of the invention, there is provided a device which shifts the phase, for the purpose of determining the rising edge, in the direction of the back porch region until the measured amplitude value falls to a predetermined percentage, for example 50% of the amplitude value determined beforehand, this value of the phase being buffer-stored as the location of the rising edge.

According to a further feature of the invention, there is provided a device which shifts the phase, for the purpose of determining the falling edge, in the direction of the front porch region until the measured amplitude value falls to a predetermined percentage, for example 50% of the amplitude value determined beforehand, this value of the phase being buffer-stored as the location of the falling edge.

Other features which are considered as characteristic for the invention are set forth in the appended claims.

Although the invention is illustrated and described herein as embodied in a method and a device for monitoring the setting of the phase in flat screens, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
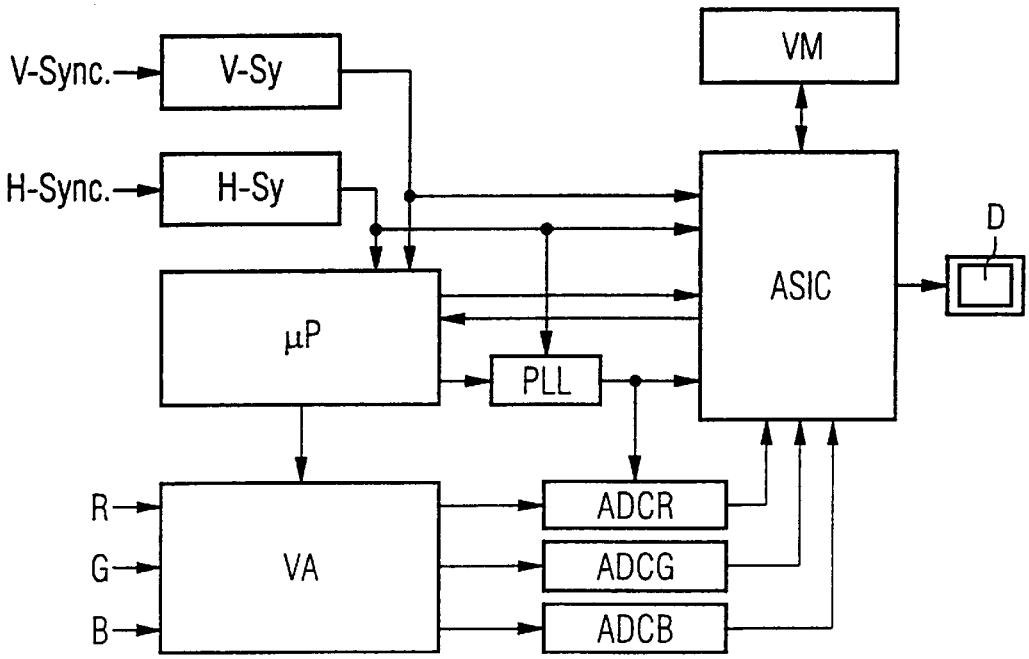
FIG. 1 is a block diagram of a flat screen which can be connected to the graphics card of a computer system via an analog interface.

Referring now to the figures of the drawings in detail and first, particularly, to FIG. 1 thereof, there is shown a control circuit for a flat screen which can be connected via an analog interface, the functioning of which will be explained in more detail below using the various input signals and the processing thereof. At the input of the control circuit there are supplied on the one hand the video signal including the three color signals R, G, B, and on the other hand the two synchronization signals H-sync and V-sync for horizontal and vertical picture synchronization. H-sync and V-sync are transmitted digitally, the signal voltage being 0 V and >3 V, respectively. The signal V-sync signals that the first line of a picture is being transmitted. Therefore, this signal corresponds to the frame frequency and is typically in the range between 60 and 85 Hz. The signal H-sync signals that a new picture line is being transmitted. This signal corresponds to the line frequency and is usually 60 kHz.

The video signal including the color signals R, G, B is an analog signal. The signal voltage lies in the range between 0 V and 0.7 V. The pixel clock rate, i.e. the frequency with which the value of this voltage can change, is 80 MHz. Since a certain number of pixels are transmitted per picture line, the pixel clock rate is higher than the line frequency (H-sync) by the number of these dots or pixels.

The three color signals R, B, G of the video signal are fed via a video amplifier VA to a respective analog-to-digital converter ADCR, ADCG and ADCB. The two synchronization signals H-sync and V-sync are processed or conditioned in separate circuits H-Sy, V-Sy to the effect that the signal edges, which have been degraded by the transmission and by various EMC (electromagnetic compatibility) measures, are refreshed again.

These synchronization signals H-sync and V-sync that have been conditioned in this respect are subsequently fed to a microprocessor $\mu$P. This microprocessor $\mu$P measures their frequency and determines from this the resolution which is set in the graphics card of the computer system. The data respectively stored with regard to the resolution are subsequently transferred to a phase-locked loop PLL and, in parallel therewith, to a logic circuit for conditioning and processing the digital data, the logic circuit being realized in the form of an ASIC (application-specific integrated circuit).

The phase-locked loop PLL multiples the frequency of the synchronization signal H-sync by the value transferred to it by the microprocessor $\mu$P. The sampling frequency (pixel clock rate) is obtained as a result of this. On account of a delay time caused in the phased-locked loop PLL, a phase difference is produced between the pixel clock rate and the sampling frequency. These two parameters can be influenced via the OSD display on the screen. The sampling frequency obtained in the phase-locked loop is additionally fed to the three analog/digital converters ADCR, ADCG, ADCB. The latter convert the analog data stream into a digital data stream. Finally, the digitized data are processed further in the downstream logic circuit ASIC with the aid of the data contained in a video memory VM. While the data are transmitted in the simplest case 1:1 to the flat screen which can be connected to the logic circuit ASIC, the video memory VM is often used to achieve a temporal decoupling between the arriving data and the data to be transmitted to the flat screen D. For the interpolation of low resolutions, likewise the data stored in the video memory VM are used.

As has already been mentioned in the introduction, in addition to the settings of the picture position, the sampling frequency and the phase in the microprocessor of the flat screen, a flag is set as soon as the phase has been set by the user, after a change which is effective with regard to the phase has been performed in the flat screen/graphics card/computer system. The values for the phase which are stored in the course of the factory setting may be just standard values or proposed values which are overwritten by the setting by the user.

In the case of new flat screens from the factory, the flags for all preset modes must be cleared. It is also the case in the event of a change in the graphics card or in the computer setting that the phase must be set anew, that is to say the corresponding flag must be cleared, in order that the user is informed of the necessary setting the next time the flat screen is started up. The same applies, of course, also to modes for which there is as yet no presetting in the flat screen.

If at any rate no flag is set and the flat screen is switched on, the microprocessor provides a message which is displayed for example via the OSD (on screen display) of the flat screen and prompts the user to effect a phase setting. Otherwise, an automatic phase setting can be initiated in the absence of the flag.

In a preferred embodiment of the invention, a check of the phase setting performed by the user is carried out or a check is made upon each mode change to determine whether the system has changed. Thus, it is also ascertained whether the phase setting carried out by the user is adequate. During this checking, it is ascertained whether the first line or the first lines above the picture region or the first line or the first lines below the picture region or the first column or the first columns next to the front porch region or the first column or the first columns next to the back porch region is/are "black". If it is ascertained during the checking that the corresponding lines are not "black", the picture is not centered correctly, and an adjustment is necessary. Even if the picture is centered, but the phase is not set correctly, at least one of the checked columns or lines is not black since some of the picture information becomes visible from the adjoining column/line of the picture region. An adjustment of the phase is then necessary in this case, too.

Finally, it should be noted that with the invention, all cases can be encompassed in which resetting of the phase is necessary, including the case where the flat screen is operated with the same resolution on a different graphics card and/or a different computer.

Figure 2A:
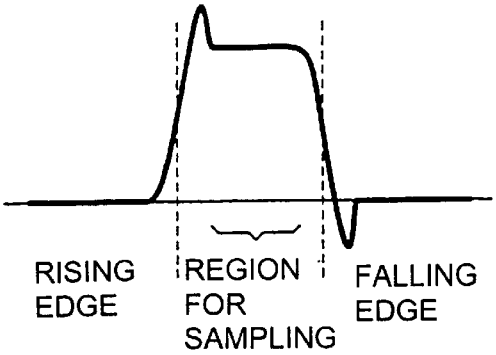
FIGS. 2A and 2B are graphs illustrating video signals.
Figure 2B:
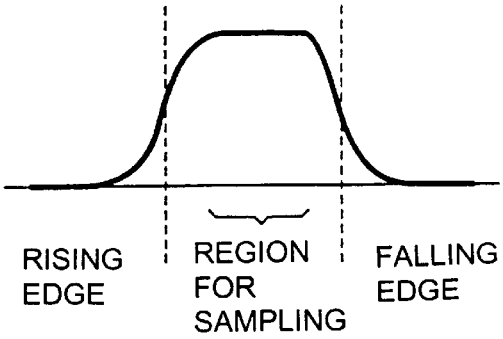
Figure 3:
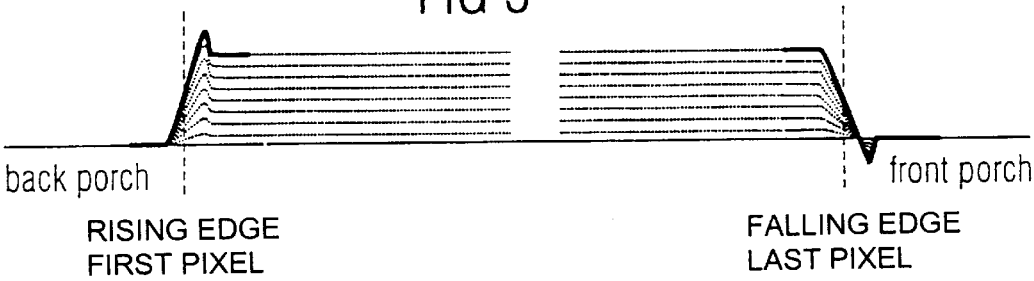
FIG. 3 is a graph illustrating the rising and falling edges of pixels of a video signal.

From the illustrations of FIGS. 2A and 2B it can firstly be seen that the phase of the sampling of the video signal is extremely important for the picture quality, and that the phase in many cases has to lie at correspondingly different locations for different video signals. Thus, FIG. 2A shows a fast video signal with overshoot, the region of sampling between the rising and falling edges of the video signal being comparatively narrow and being shifted in the direction of the falling edge. By contrast, FIG. 2B shows a sluggish, slow-response video signal without overshoot, the region for sampling between the rising edge and the falling edge being relatively wide and being essentially centered. On consideration of the two signals, it is evident that there are phase angles, for example at the right-hand margin in the region of the falling edge in the case of the sluggish video signal, in the case of which the measured amplitude values are no longer usable in the case of the sluggish video signal, whereas amplitude values that are still usable are measured at the same phase angle in the case of the fast video signal. On the other hand, it is evident that the ideal phase angle lies approximately in the center between the rising and falling edges of the video signal and, moreover, must be set to this value. This is why the setting of the phase in a manner dependent on the respective system is so important.

As has already been mentioned, automatic phase setting is more problematic than the settings of the remaining parameters. A description of how such automatic setting can be performed will now follow with reference to the further figures.

The determination of the phase angle or phase position is based on the edges of the video signals. In order to be able to determine an edge, it is advantageous if the edge is as pronounced as possible. This is the case if the signal is as low as possible before the edge and is highly pronounced after the edge, or vice versa. The first requirement is ideally satisfied by the sampling interval or scanning gap related to a back and front porch region, and the second by a bright pixel. Accordingly, a bright pixel at the start of a line is highly suitable for determining the rising edge, and one at the end of a line is highly suitable for determining the falling edge.

The fact that edges of two different dots are involved that are possibly situated on different picture lines is unimportant, because the pixel and sampling clock rate is known and can accordingly be taken into account. The pixels chosen should have a sufficiently high intensity in at least one primary color (RGB), in order that an edge of sufficiently large amplitude is found.

In principle, any combination of a bright and a dark pixel, which may lie at any location in the video signal, is suitable for determining the edges. In most cases, the edges sought can be determined by the combination of a front/back porch region and a bright pixel in the first/last picture column. Searching the entire picture content for two suitable pairs of dots is then obviated.

As already illustrated further above, the ideal region for sampling the video signal is the region in which the desired and actual values of the signal largely correspond. However, the measurement of the amplitude of the video signal in the region of the edge is difficult. The reason for this is the jitter of the video signal and of the sampling pulse. If this jitter is large relative to the rise and/or fall time of the video signal, then although the edge can be found by averaging a plurality of measurements, a statement about the amplitude of the edge at the measured location cannot be made.

Figure 4A:
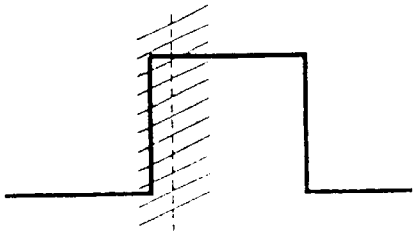
FIGS. 4A and 4B are graphs illustrating two ideal video signals and the effect of the position of the sampling pulse in relation to the video signal.
Figure 4B:
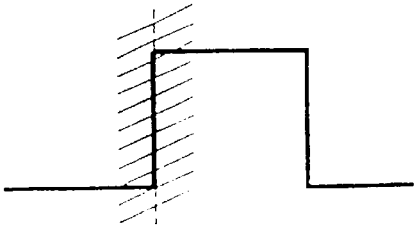

FIGS. 4A and 4B illustrate the difficulties in detecting the edges. Broken lines representing the desired sampling instant have been inserted into the ideal video signals. The hatched area represents the region actually sampled as a result of the jitter during different measurements. If the measured values were averaged, an average value of approximately 80% results in the first case. One might interpret this averaged value erroneously as a position on the rising edge, to be precise exactly on the location at which the rising edge has reached 80% of its amplitude. This is not the case, however. The statement would be 50% in the second case, which is more likely to be correct.

It can be seen from these results that, owing to the jitter it will hardly be possible to determine the location of the edge at which the edge has reached a specific value. The least error will usually be made when approximately 50% of the desired value is reached by averaging the measured values. It goes without saying that other values can also be sought. Smaller values have the advantage, for example, that the actual amplitude of the pixel has to be determined less accurately.

It is assumed hereinafter that the picture position and the sampling frequency have already been set correctly. Moreover, access to the data of the A/D converters should be possible. The rising edge and the falling edge are determined as follows; the following steps being carried out.

Rising edge:

A) Search for a point in the first picture column which has a sufficiently high, possibly a maximum R, G or B value.

B) Since the phase in A) might have been preset in such a way that the measurement is erroneous, the actual value of the amplitude may be higher. Determine the actual value of the amplitude through the use of a measurement at a suitable sampling instant, by delaying the phase until the measured amplitude values no longer rise any further, or by firstly advancing the phase until the measured amplitude values are very low and additionally delaying this value of the phase, the value marking the start of the edge, by half the pixel width.

C) Shift the phase in the direction of the back porch until the sample or sampling value averaged over a plurality of measurements falls to approximately 50% of the value determined in B). Buffer-store this value of the phase since the rising edge is situated here.

Falling edge:

4. Search for a point in the last picture column which has a sufficiently high, possibly a maximum R, G and B value. In this case, too, a single measurement suffices for each pixel to be investigated. In order to obtain measured values which are as accurate as possible, the phase should be set, prior to sampling, to the value found in B).

E) Shift the phase in the direction of the front porch until the averaged sample falls to approximately 50% of the value determined in D). The falling edge is situated at this point.

As an alternative, the sampling instant can also be determined as follows: the rising edge of a video pulse of a sufficiently bright pixel is determined, and the phase is set in such a way that the sampling instant is shifted approximately by half a pixel width in the direction of the pixel center, or, as an alternative, the falling edge of the video pulse in a sufficiently bright pixel is determined, and the phase is set in such a way that the sampling instant is shifted approximately by half a pixel width in the direction of the pixel center. Steps A) to E) described above are then simplified accordingly.

Theoretically, the ideal sampling instant lies exactly between the two edges. In practice, it may be advantageous to effect sampling not exactly in the center between the two edges but with a slight delay, in order to avoid possible overshoots of the graphics card, and also to take account of the often slightly exponential character of the edges.

The hardware embodiment of the invention includes a device which determines the rising edge of a video pulse of a sufficiently bright pixel, a device which determines the falling edge of the video pulse in a sufficiently bright pixel, a setting device which sets the phase in such a way that the sampling instant is located approximately in the center between the rising and falling edges of a video pulse, and a device for shifting the phase, for the purpose of determining the sample of the pixel, until the measured amplitude values no longer differ significantly, the sample which is then determined being processed further.

Furthermore, a device is provided which advances the phase used during the determination of the sample until the measured amplitude values are less than a predetermined limit value, for example less than 50% of the sample, and of a device which then delays the phase by half a pixel width, the sample which is then measured being processed further.

Finally, a device is provided which shifts the phase, for the purpose of determining the rising edge, in the direction of the back porch region until the measured amplitude value falls to a predetermined percentage, for example 506 of the amplitude value determined beforehand, this value of the phase being buffer-stored as the location of the rising edge. Also a device is provided which shifts the phase, for the purpose of determining the falling edge, in the direction of the front porch region until the measured amplitude value falls to a predetermined percentage, for example 50% of the amplitude value determined beforehand, this value of the phase being buffer-stored as the location of the falling edge.

We claim:

1. A method for monitoring, in a system including a flat screen, a graphics card and a computer, a setting of a phase between a pixel clock of the graphics card and a sampling clock of the flat screen having an analog interface, the method which comprises:

setting a flag upon the phase between the pixel clock and the sampling clock being set from a user-side;

examining the setting of the flag upon performing at least one operation selected from the group consisting of switching on the flat screen, exchanging the graphics card, and exchanging the computer;

providing a display indication or initiating a setting of the phase if, during the examining step, it is ascertained that the flag is not set;

checking if at least a first line above a picture region is "black" after the setting of the phase and upon an identification of a mode change; and setting the flag only when the checking step yields a positive result.

2. The method according to claim 1, which comprises clearing the flag after switching the video mode at the computer.

3. The method according to claim 1, which comprises clearing the flag after exchanging the graphics card.

4. The method according to claim 1, which comprises clearing the flag after exchanging the computer.

5. The method according to claim 1, which comprises selectively setting and clearing the flag in a microprocessor in the flat screen.

6. The method according to claim 1, which comprises providing the display indication via an on screen display.

7. The method according to claim 1, which comprises initiating an automatic setting of the phase.

8. The method according to claim 7, which comprises:

determining a rising edge of a video pulse of a sufficiently bright pixel;

determining a falling edge of the video pulse in a sufficiently bright pixel; and setting the phase such that a sampling instant is provided substantially in a center region between the rising edge and the falling edge of the video pulse.

9. The method according to claim 8, which comprises:

providing, on the flat screen, a picture region with pixels disposed in lines and columns between a back porch region and a front porch region;

selecting a pixel in a first picture column next to the back porch region as the sufficiently bright pixel for determining the rising edge; and selecting a further pixel in a first picture column next to the front porch region as a further sufficiently bright pixel for determining the falling edge.

10. The method according to claim 9, which comprises:

measuring a brightness of a plurality of pixels in a first picture column and in a last picture column;

selecting given ones of the pixels having a greatest brightness in the first picture column and in the last picture column for determining the rising edge and the falling edge of the video pulse.

11. The method according to claim 10, which comprises:

measuring the brightness of the pixels by firstly measuring the pixels ($n \times k$), where $n=1, 2, \ldots N$, with N being an integer number and k being a given constant; and if the sufficiently bright pixel has not been found, measuring the pixels $(n+m) \times k$ where $m=1, 2, \ldots N$, until the sufficiently bright pixel is found.

12. The method according to claim 11, which comprises performing the measuring step with the given constant k being equal to ten.

13. The method according to claim 9, which comprises shifting the phase until measured pixel amplitude values no longer change significantly and then determining a given pixel amplitude value for a further processing.

14. The method according to claim 9, which comprises:

advancing the phase used during a determination of an amplitude value until measured amplitude values are less than a given limit value;

delaying the phase by substantially half a pixel width for measuring the amplitude value; and further processing the amplitude value.

15. The method according to claim 14, which comprises advancing the phase used during the determination of the amplitude value until the measured amplitude values are less than half of a previously determined amplitude value.

16. The method according to claim 9, which comprises shifting the phase in a direction of a back porch region until a measured amplitude value falls to substantially half of a previously determined amplitude value for determining the rising edge; and buffer-storing a value of the phase as a location of the rising edge.

17. The method according to claim 9, which comprises delaying one of the phase and a sampling instant relative a center between the rising edge and the falling edge by a given amount of a pixel width.

18. The method according to claim 9, which comprises delaying one of the phase and a sampling instant relative a center between the rising edge and a falling edge by substantially 10% of a pixel width.

19. The method according to claim 7, which comprises:

determining a rising edge of a video pulse of a sufficiently bright pixel; and setting the phase such that a sampling instant is shifted substantially by half a pixel width in a direction of a pixel center.

20. The method according to claim 19, which comprises:

providing, on the flat screen, a picture region with pixels disposed in lines and columns between a back porch region and a front porch region; and selecting a pixel in a first picture column next to the back porch region as the sufficiently bright pixel for determining the rising edge.

21. The method according to claim 19, which comprises:

measuring a brightness of a plurality of pixels of a first picture column; and selecting given ones of the pixels having a greatest brightness in the first picture column for determining the rising edge of the video pulse.

22. The method according to claim 21, which comprises:

measuring the brightness of the pixels by firstly measuring the pixels (n×k), where n=1, 2, . . . N, with N being an integer number and k being a given constant; and if the sufficiently bright pixel has not been found, measuring the pixels (n+m)×k where m=1, 2, . . . N, until the sufficiently bright pixel is found.

23. The method according to claim 19, which comprises shifting the phase until measured pixel amplitude values no longer change significantly and then determining a given pixel amplitude value for a further processing.

24. The method according to claim 19, which comprises:

advancing the phase used during a determination of an amplitude value until measured amplitude values are less than a given limit value;

delaying the phase by substantially half the pixel width for measuring the amplitude value; and further processing the amplitude value.

25. The method according to claim 19, which comprises:

shifting the phase in a direction of a back porch region until a measured amplitude value falls to a given percentage of a previously determined amplitude value for determining the rising edge; and buffer-storing a value of the phase as a location of the rising edge.

26. The method according to claim 19, which comprises delaying one of the phase and a sampling instant relative to a center between the rising edge and a falling edge by a given amount of the pixel width.

27. The method according to claim 19, which comprises delaying one of the phase and a sampling instant relative a center between the rising edge and a falling edge by substantially 10% of the pixel width.

28. The method according to claim 7, which comprises:

determining a falling edge of a video pulse in a sufficiently bright pixel; and setting the phase such that a sampling instant is shifted substantially by half a pixel width in a direction of a pixel center.

29. The method according to claim 28, which comprises:

providing, on the flat screen, a picture region with pixels disposed in lines and columns between a back porch region and a front porch region; and selecting a pixel in a first picture column next to the front porch region as the sufficiently bright pixel for determining the falling edge.

30. The method according to claim 28, which comprises:

measuring a brightness of a plurality of pixels of a last picture column; and selecting given ones of the pixels having a greatest brightness in the last picture column for determining the falling edge of the video pulse.

31. The method according to claim 30, which comprises:

measuring the brightness of the pixels by firstly measuring the pixels (n×k), where n=1, 2, . . . N, with N being an integer number and k being a given constant; and if the sufficiently bright pixel has not been found, measuring the pixels (n+m)×k where m=1, 2, . . . N, until the sufficiently bright pixel is found.

32. The method according to claim 28, which comprises shifting the phase until measured pixel amplitude values no longer change significantly and then determining a given pixel amplitude value for a further processing.

33. The method according to claim 28, which comprises:

advancing the phase used during a determination of an amplitude value until measured amplitude values are less than a given limit value;

delaying the phase by substantially half the pixel width for measuring the amplitude value; and further processing the amplitude value.

34. The method according to claim 28, which comprises:

shifting the phase in a direction of a front-porch region until a measured amplitude value falls to a given percentage of a previously determined amplitude value for determining the falling edge; and buffer-storing a value of the phase as a location of the falling edge.

35. The method according to claim 28, which comprises shifting the phase in a direction of a front porch region until a measured amplitude value falls to substantially half of a previously determined amplitude value for determining the falling edge; and buffer-storing a value of the phase as a location of the falling edge.

36. The method according to claim 28, which comprises delaying one of the phase and a sampling instant relative a center between a rising edge and the falling edge by a given amount of the pixel width.

37. The method according to claim 28, which comprises delaying one of the phase and a sampling instant relative a center between a rising edge and the falling edge by substantially 10% of the pixel width.

38. A method for monitoring, in a system including a flat screen, a graphics card and a computer, a setting of a phase between a pixel clock of the graphics card and a sampling clock of the flat screen having an analog interface, the method which comprises:

setting a flag upon the phase between the pixel clock and the sampling clock being set from a user-side;

examining the setting of the flag upon performing at least one operation selected from the group consisting of switching on the flat screen, exchanging the graphics card, and exchanging the computer;

providing a display indication or initiating a setting of the phase if, during the examining step, it is ascertained that the flag is not set;

checking if at least a first line below a picture region is "black" after the setting of the phase and upon an identification of a mode change; and setting the flag only when the checking step yields a positive result.

39. A method for monitoring, in a system including a flat screen, a graphics card and a computer, a setting of a phase between a pixel clock of the graphics card and a sampling clock of the flat screen having an analog interface, the method which comprises:

setting a flag upon the phase between the pixel clock and the sampling clock being set from a user-side;

examining the setting of the flag upon performing at least one operation selected from the group consisting of switching on the flat screen, exchanging the graphics card, and exchanging the computer;

providing a display indication or initiating a setting of the phase if, during the examining step, it is ascertained that the flag is not set;

checking if at least a first column of a front porch region is "black" after the setting of the phase and upon an identification of a mode change; and setting the flag only when the checking step yields a positive result.

40. A method for monitoring, in a system including a flat screen, a graphics card and a computer, a setting of a phase between a pixel clock of the graphics card and a sampling clock of the flat screen having an analog interface, the method which comprises:

setting a flag upon the phase between the pixel clock and the sampling clock being set from a user-side;

examining the setting of the flag upon performing at least one operation selected from the group consisting of switching on the flat screen, exchanging the graphics card, and exchanging the computer;

providing a display indication or initiating a setting of the phase if, during the examining step, it is ascertained that the flag is not set;

checking if at least a first column of a back porch region is "black" after the setting of the phase and upon an identification of a mode change; and setting the flag only when the checking step yields a positive result.

41. In a system including a computer, a graphics card operating with a pixel clock, and a flat screen with an analog interface and operating with a sampling clock, a device for monitoring a setting of a phase between the pixel clock and the sampling clock, comprising:

a microprocessor setting a flag upon a phase between the pixel clock and the sampling clock being set from a user-side;

said microprocessor performing an examination of the setting of the flag upon at least one operation selected from the group consisting of switching on the flat screen, exchanging the graphics card, and exchanging the computer;

said microprocessor initiating at least one of a display indication and a setting of the phase, if the examination ascertains that the flag is not set;

a checking device for determining, after the setting of the phase and upon an identification of a mode change, if at least one of a plurality of picture elements is "black", the picture elements including a first line above a picture region, a first line below the picture region, a first column of a front porch region, and a first column of a back porch region; and said microprocessor setting the flag only when the checking device yields a positive result.

42. The device according to claim 41, wherein said microprocessor clears the flag after at least one operation selected from the group consisting of changing the video mode at the computer, exchanging the graphics card, and exchanging the computer.

43. The device according to claim 41, wherein said microprocessor is disposed in the flat screen.

44. The device according to claim 41, including a display device connected to said microprocessor, said display device outputting the display indication via an on screen display.

45. The device according to claim 41, including a setting device for initiating an automatic setting of the phase.

46. The device according to claim 41, including:

a first device for determining a rising edge of a video pulse of a sufficiently bright pixel in a first picture column next to a back porch region;

a second device for determining a falling edge of the video pulse in a sufficiently bright pixel in a last picture column next to a front porch region; and a setting device for setting the phase such that a sampling instant is provided substantially in a center region between the rising edge and the falling edge of the video pulse.

47. The device according claim 46, including a further device for shifting the phase in order to determine a sampling value of the pixel, said further device shifting the phase until measured amplitude values no longer differ significantly from one another, and the sampling value, which is determined when the measured amplitude values no longer differ significantly, being further processed.

48. The device according to claim 46, including:

a third device for advancing the phase used during a determination of a sampling value until measured amplitude values are smaller than a given limit value; and a fourth device for subsequently delaying the phase by substantially half a pixel width, and the sampling value which is then measured being further processed.

49. The device according to claim 46, including:

a third device for advancing the phase used during a determination of a sampling value until measured amplitude values are less than 50% of the sampling value; and a fourth device for subsequently delaying the phase by substantially half a pixel width, and the sampling value which is then measured being further processed.

50. The device according to claim 46, including a further device for shifting the phase, for the purpose of determining the rising edge, in a direction of the back porch region until a measured amplitude value falls to a given percentage of a previously determined amplitude value; and a buffer storage for storing the measured amplitude value as a location of the rising edge.

51. The device according to claim 46, including a further device for shifting the phase, for the purpose of determining the rising edge, in a direction of the back porch region until a measured amplitude value falls to substantially 50% of a previously determined amplitude value; and a buffer storage for storing the measured amplitude value as a location of the rising edge.

52. The device according to claim 46, including a further device for shifting the phase, for the purpose of determining the falling edge, in a direction of the front porch region until the measured amplitude value falls to a given percentage of a previously determined amplitude value; and a buffer storage for storing the measured amplitude value as a location of the falling edge.

53. The device according to claim 41, including:

a device for determining a rising edge of a video pulse of a sufficiently bright pixel in a first picture column next to a back porch region; and a setting device for setting the phase such that a sampling instant is shifted substantially by half a pixel width in a direction of a pixel center.

54. The device according claim 53, including a further device for shifting the phase in order to determine a sampling value of the pixel, said further device shifting the phase until measured amplitude values no longer differ significantly from one another, and the sampling value, which is determined when the measured amplitude values no longer differ significantly, being further processed.

55. The device according to claim 53, including:

an advancing device for advancing the phase used during a determination of a sampling value until measured amplitude values are smaller than a given limit value; and a delaying device for subsequently delaying the phase by substantially half a pixel width, and the sampling value which is then measured being further processed.

56. The device according to claim 53, including:

an advancing device for advancing the phase used during a determination of a sampling value until measured amplitude values are less than 50% of the sampling value; and a delaying device for subsequently delaying the phase by substantially half a pixel width, and the sampling value which is then measured being further processed.

57. The device according to claim 53, including a further device for shifting the phase, for the purpose of determining the rising edge, in a direction of the back porch region until a measured amplitude value falls to a given percentage of a previously determined amplitude value; and a buffer storage for storing the measured amplitude value as a location of the rising edge.

58. The device according to claim 53, including a further device for shifting the phase, for the purpose of determining the rising edge, in a direction of the back porch region until the measured amplitude value falls to substantially 50% of a previously determined amplitude value; and a buffer storage for storing the measured amplitude value as a location of the rising edge.

59. The device according to claim 41, including:

a device for determining a falling edge of a video pulse in a sufficiently bright pixel in a last picture column next to a front porch region; and a setting device for setting the phase such that a sampling instant is shifted substantially by half a pixel width in a direction of a pixel center.

60. The device according claim 59, including a further device for shifting the phase in order to determine a sampling value of the pixel, said further device shifting the phase until measured amplitude values no longer differ significantly from one another, and the sampling value, which is determined when the measured amplitude values no longer differ significantly, being further processed.

61. The device according to claim 59, including:

an advancing device for advancing the phase used during a determination of a sampling value until measured amplitude values are smaller than a given limit value; and a delaying device for subsequently delaying the phase by substantially half a pixel width, and the sampling value which is then measured being further processed.

62. The device according to claim 59, including:

an advancing device for advancing the phase used during a determination of a sampling value until measured amplitude values are less than 50% of the sampling value; and a delaying device for subsequently delaying the phase by substantially half a pixel width, and the sampling value which is then measured being further processed.

63. The device according to claim 59, including a further device for shifting the phase, for the purpose of determining the falling edge, in a direction of the front porch region until the measured amplitude value falls to substantially 50% of a previously determined amplitude value; and a buffer storage for storing the measured amplitude value as a location of the falling edge.

64. The device according to claim 59, including a device for shifting the phase, for the purpose of determining the falling edge, in a direction of the front porch region until the measured amplitude value falls to a given percentage of a previously determined amplitude value; and a buffer storage for storing the measured amplitude value as a location of the falling edge.

* * * * *

UNITED STATES PATENT AND TRADEMARK OFFICE

CERTIFICATE OF CORRECTION

PATENT NO. : 6,693,628 B1
DATED : February 17, 2004
INVENTOR(S) : Paul von Hase et al.

It is certified that error appears in the above-identified patent and that said Letters Patent is hereby corrected as shown below:

Title page,
Item [30], Foreign Application Priority Data, should read as follows:
-- Mar. 26, 1999 [DE] ……. 199 13 915 --

Signed and Sealed this

Twenty-seventh Day of April, 2004

JON W. DUDAS
*Acting Director of the United States Patent and Trademark Office*